US006688827B2

(12) United States Patent
Gelb

(10) Patent No.: US 6,688,827 B2
(45) Date of Patent: Feb. 10, 2004

(54) PROTECTIVE DEVICE FOR AN ACICULATE OBJECT

(76) Inventor: Ronald Gelb, 7216 Whitfield Ave., Boynton Beach, FL (US) 33437

( * ) Notice: Subject to any disclaimer, the term of this patent is extended or adjusted under 35 U.S.C. 154(b) by 0 days.

(21) Appl. No.: 10/227,991

(22) Filed: Aug. 26, 2002

(65) Prior Publication Data

US 2002/0192049 A1 Dec. 19, 2002

Related U.S. Application Data

(63) Continuation-in-part of application No. 09/515,783, filed on Feb. 29, 2000.

(51) Int. Cl.[7] ..... A47G 3/00
(52) U.S. Cl. ..... 411/372.6; 411/526; 403/11
(58) Field of Search ..... 411/525, 526, 411/301, 372.5–377, 429, 400; 63/12, 13; 24/706.3; 403/11

(56) References Cited

U.S. PATENT DOCUMENTS 2,144,926 A * 1/1939 Lawton
2,878,905 A * 3/1959 Langermeier
3,411,816 A * 11/1968 Andrews
3,552,734 A * 1/1971 Severino
4,787,793 A * 11/1988 Harris
5,059,077 A * 10/1991 Schmid
5,129,292 A * 7/1992 Albert
5,697,745 A * 12/1997 Shaw

OTHER PUBLICATIONS

"How to Make a Pantograph", Hubert van Hacke, Apr. 1998.*
"Eyeing the Forgotton Fifth Wall", The New York Times, Mar. 28, 2002.*

* cited by examiner

*Primary Examiner*—Flemming Saether
(74) *Attorney, Agent, or Firm*—Jon A. Gibbons; Fleit, Kain, Gibbons, Gutman, Bongini & Bianco P.L.

(57) ABSTRACT

A protective device for an aciculate object includes a body, a capture, and a protective cap. The body is a geometric shape with two ends. The body has a longest side of length L1. The body is resistant to deformation along an axis parallel to the longest side of the body. The capture is formed into the body at one end. The protective device is pushed over a pointy or pointed end of the aciculate object positively engaging the capture of the protective device. The capture retains the aciculate object and resists movement of the aciculate object coaxially off the aciculate object and in a direction normal to an axis parallel to the longest side of the body. The protective cap is mounted to the end of the body opposite the capture. The protective cap has a diameter L2, such that L2 is less than L1. The protective cap is resistant to penetration from the pointy or pointed of the aciculate object.

21 Claims, 5 Drawing Sheets

700

PROTECTIVE DEVICE FOR AN ACICULATE OBJECT

CROSS REFERENCE TO RELATED APPLICATIONS

This is a continuation-in-part of a non-provisional patent application Ser. No. 09/515,783 filed Feb. 29, 2000 now [20020192049], for "Protective Utensil for a Sharp-Pointed Object." The above aforementioned patent application is incorporated hereinto in its entirety by reference.

BACKGROUND OF THE INVENTION

1. Field of the Invention

The invention generally relates to protective devices and more specifically to protective devices for objects with pointy or pointed ends.

2. Description of the Related Art

Many hazards exist in buildings and homes due to current construction methods. One such hazard is an aciculate object that is left after construction. Some of the aciculate objects are present in inaccessible areas and present no danger. However, aciculate objects can be found in areas that are accessible which present a significant hazard. One example area is the attic of homes. Construction of the home and installation of the roof and roof covering material results in a pointy or pointed end of an aciculate objects, such as a nail, protruding from surfaces throughout the attic. An encounter with the pointy or pointed of such an aciculate object can cause severe injury and subsequent infection problems. The pointy or pointed of the nail readily puncture skin and can penetrate deep within the body. Furthermore, the nail will oxidize (e.g., rust) overtime and combined with naturally occurring bacteria present problems with infections, such as tetanus, after the nail punctures the skin. Tetanus is a painful and usually fatal disease that is caused by bacterial infection through a deep wound which can, for example, result from an encounter with the pointy or pointed of a nail.

To prevent injuries from aciculate objects, as described above, one well known method is to use a blunt object, such as a hammer, to bend the shaft of the aciculate object leading to the pointy or pointed. The pointy or pointed of the aciculate object will be directed so as to minimize the hazard presented by the pointy or pointed of the aciculate object. This method of prevention is not without its shortcoming and problems. One problem is the loosening of the aciculate object from the position in which it was originally placed. This results in a substandard connection. The substandard connection leads to leakage problems if, for example, the aciculate object was a nail securing the roof covering material in place. The covering material will not be securely mounted to the roof allowing moisture penetration. Furthermore, the loosening of the nail will permit moisture to accumulate and leak past the roof boundary. Additionally, the resultant substandard connection results in a structure that is below the expectations of the builder and creates a significant safety hazard during extremes conditions, for example, high winds and severe rainy conditions. Accordingly, a need exists to overcome these problems and to provide a protective device that covers the pointy or pointed of an aciculate object.

Another method of protection from aciculate objects is to place a cork over the pointy or pointed of the aciculate object. This method is convenient but results in significant problems. One problem is the inability of the cork to prevent penetration of the pointy or pointed of the aciculate throughout the length of the cork. If, for example, contact is in a direction parallel to and centered on the pointy or pointed of the aciculate object, the cork will not prevent penetration out of the end of the cork. This is significant because the cork will present a misleading safety aspect which can lead to carelessness and injury. Furthermore, the cork is similarly substandard to penetration if the aciculate object is inserted into the cork in a skewed direction as the cork is penetrable from any direction. Additionally, the cork is not durable and will become degraded over time resulting in a reduced capacity to adhere to the aciculate object and further substandard performance as a protective device. Accordingly, a need exists to overcome these problems and to provide a protective device with a protective cap that is not penetrable and which is retained on the aciculate object.

SUMMARY OF THE INVENTION

Briefly, in accordance with the present invention, disclosed is a protective device for an aciculate object. The protective device comprises a body with a geometric shape with two ends. The body geometric shape comprise the following: cylindrical; triangular; pentagonal; hexagonal; and square. The body of the protective device has a longest side L1. A protective cap is mounted to an end of the body. The protective cap has a diameter L2. The protective cap diameter L2 is less than the body longest side L1. A capture is formed into the end of the body opposite the protective cap. The protective device is pushed over a pointy or pointed end of the aciculate object positively engaging the capture of the protective device. The capture retains the aciculate object and resists movement of the aciculate object coaxially off the aciculate object and in a direction normal to an axis parallel to the longest side of the body. The protective cap is formed from a material that is resistant to penetration from the pointy or pointed of the aciculate object. The body is resistant to deformation along an axis parallel to the longest side of the body.

BRIEF DESCRIPTION OF THE DRAWINGS

The subject matter that is regarded as the invention is particularly pointed out and distinctly claimed in the claims at the conclusion of the specification. The foregoing and other features, and advantages of the invention will be apparent from the following detailed description taken in conjunction with the accompanying drawings. Additionally, the left-most digit of a reference number identifies the drawing in which the reference number first appears.

DETAILED DESCRIPTION OF THE PREFERRED EMBODIMENTS

It is important to note, that these embodiments are only examples of the many advantageous uses of the innovative teachings herein. In general, statements made in the specification of the present application do not necessarily limit any of the various claimed inventions. Moreover, some statements may apply to some inventive features but not to others. In general, unless otherwise indicated, singular elements may be in the plural and visa versa with no loss of generality.

The present invention, according to a preferred embodiment, overcomes drawbacks and problems with the prior art by providing a protective device for an aciculate object with a non-penetrable protective cap and which is retained on the aciculate object. Preferred embodiments of the present invention is now described.

Figure 1:
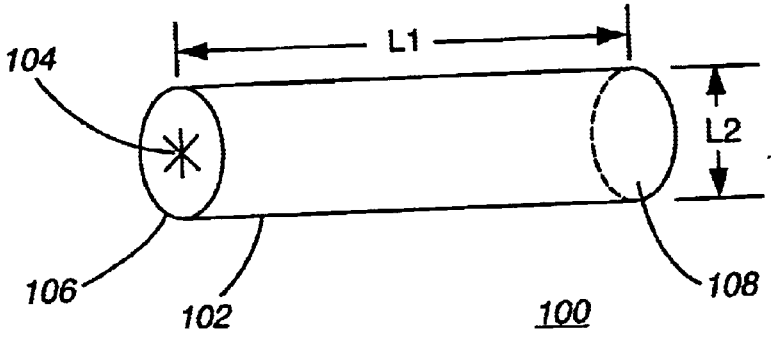
FIG. 1 is an elevated side view, front perspective, of a protective device for an aciculate object, according to the present invention.

FIG. 1 is an elevated side view, front perspective, of a protective device 100 for an aciculate object. The protective device 100 comprises a body 102 with a substantially cylindrical shape. In another embodiment the body 102 is a geometric shape including a triangle, a pentagon, a hexagon, and a square (not shown). The body 102 longest side length is L1. The body 102 are formed from one or more of the following a metal, a ceramic, a plastic, a wood, and a rubber. In another embodiment, the plastic are formed from one or more of the following a non-fluorescent and fluorescent plastic so as to glow in the dark or glow when exposed to a black light. In an alternative embodiment, the body 102 is filled at least in part with a fill material that engages at least part of an aciculate object (not shown). The fill material is formed from one or more of the following a plastic, a foam, and an adhesive. The body 102 is formed to be colored including white or translucent. The body 102 is decorated with a design, an image and/or is not decorated (as shown). The body 102 has a first end 106 and a second end 108. A capture 104 is formed into the first end of the body 102. The capture 104 retains the aciculate object to keep it attached and not slip off and so as to resist movement of the aciculate object in a direction normal to an axis parallel to the longest side of the body 102.

Figure 2:
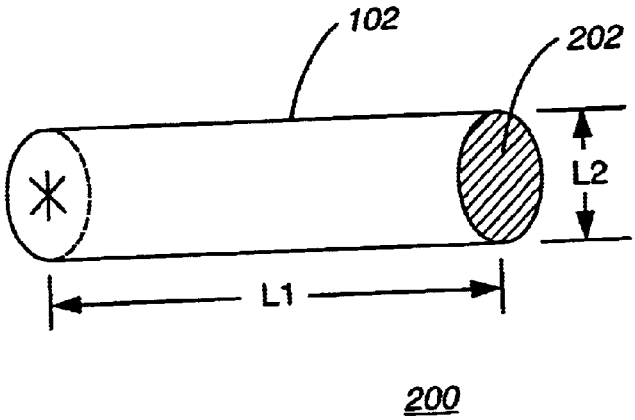
FIG. 2 is an elevated side view, rear perspective, of FIG. 1, according to the present invention.

FIG. 2 is an elevated side view, rear perspective, 200 of FIG. 1. A protective cap 202 is mounted or disposed onto the second end 108 of the body 102. The protective cap 202 diameter is L2. The protective cap 202 diameter L2 is less than the body longest side L1. The protective cap 202 is formed from a material being resistant to penetration there through from the pointy or pointed of the aciculate object. Although the protective cap is shown as being flat, other shapes such as bullet or concave or convex shapes are within the true scope and spirit of the present invention. Moreover, the body 102 or the protective device 100 in another embodiment is coated with a rubber, foam, or plastic coating so as to provide a cushion against the surface of the skin as an additional level of protection against scrapes and cuts and lacerations.

Figure 3:
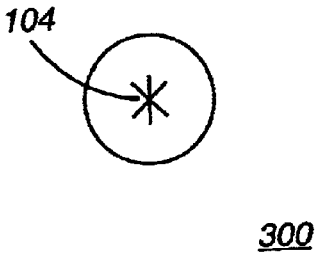
FIG. 3 is an elevated front view of FIG. 1, according to the present invention.
Figure 7:
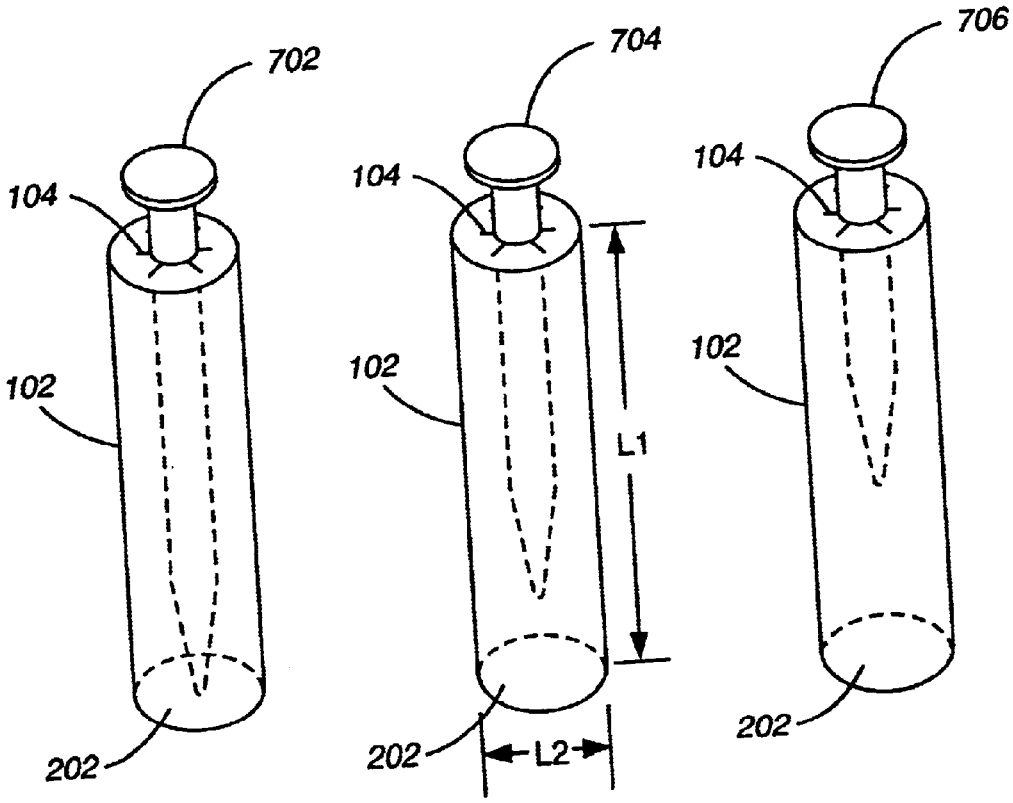
FIG. 7 is and elevated view of the protective device of FIG. 1 with three different lengths of nails retained in the protective device, according to the present invention.

FIG. 3 is an elevated front view 300 of FIG. 1. The capture 104 is formed into the first end 106 of the body 102. The capture 104 is are formed from one or more of the following a capture nut, a push nut, and a plastic insert with substantially the same shape as the body 102 with a hole with diameter L3 which is less than a diameter of the aciculate object (not shown). The protective device 100 is pushed over a pointy or pointed end of the aciculate object positively engaging the capture 104 of the protective device as illustrated in FIG. 7.

Figure 4:
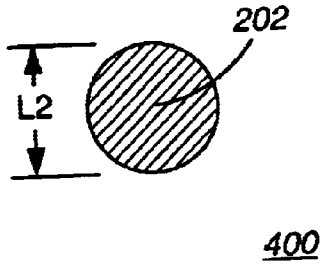
FIG. 4 is an elevated rear view of FIG. 1, according to the present invention.

FIG. 4 is an elevated rear view 400 of FIG. 1. A protective cap 202 is mounted to the second end 108 of the body 102. The protective cap 202 diameter is L2. The protective cap 202 are formed from one or more of the following a metal, a ceramic, a plastic, a wood, and a rubber. In an alternate embodiment, the protective cap 202 further are formed from one or more of the following an exterior hook, such as a cup hook, disposed therefrom for holding object thereon (not shown).

Figure 5:
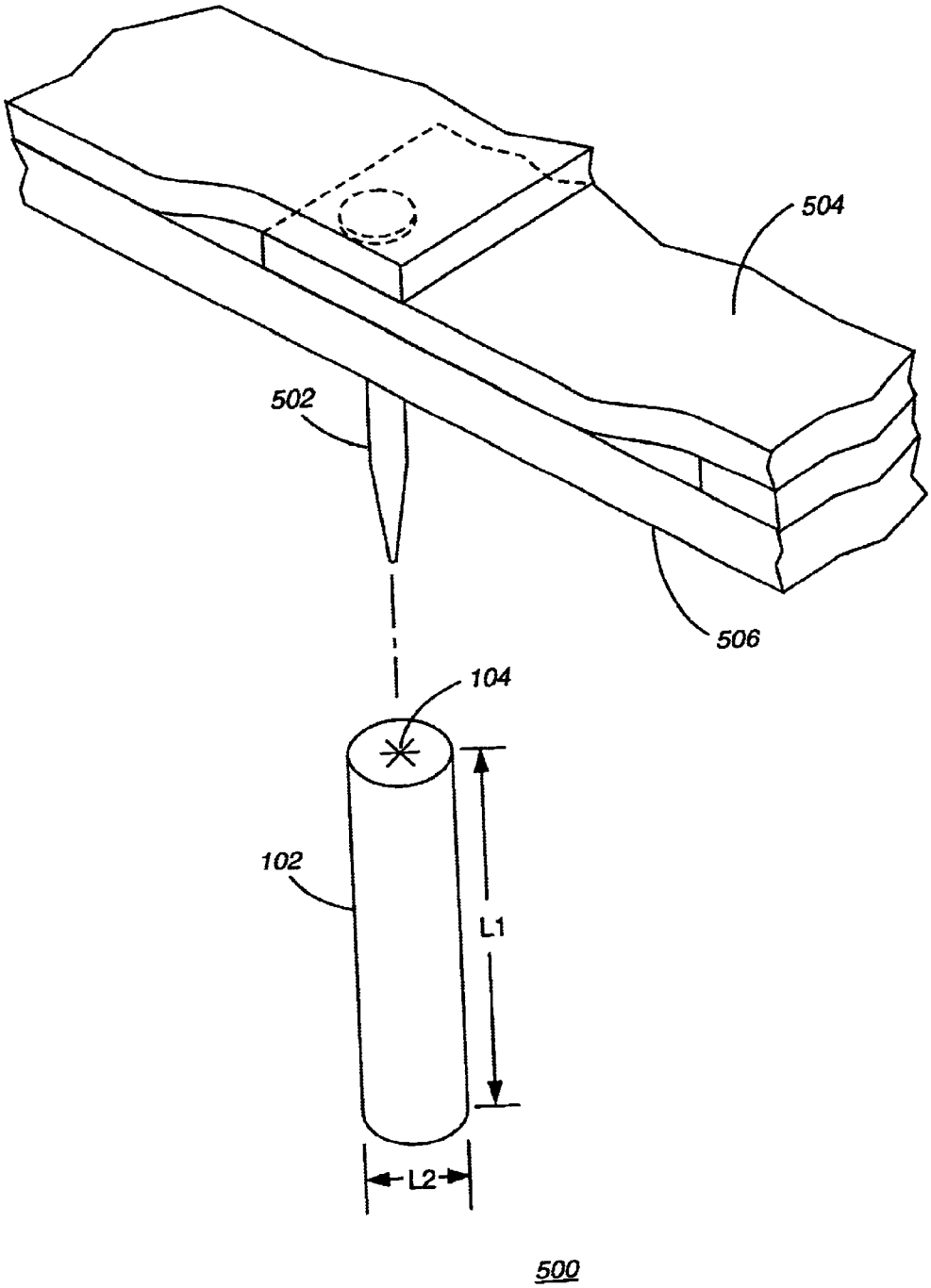
FIG. 5 is an environmental view of the protective device of FIG. 1 and a nail, according to the present invention.

FIG. 5 is an environmental view 500 of the protective device of FIG. 1 and a nail. The nail 502 secures a roof shingle 504 to a roof 506. The pointy or pointed of the nail 502 penetrates through the roof shingle 504 and the roof 506. The protective device 100 is pushed over the pointy or pointed end of the nail 502 so as to enter the capture 104. The capture 104 retains the nail 502 so as to resist movement of the nail 502 in a direction normal to an axis parallel to the longest side of the body 102.

Figure 6:
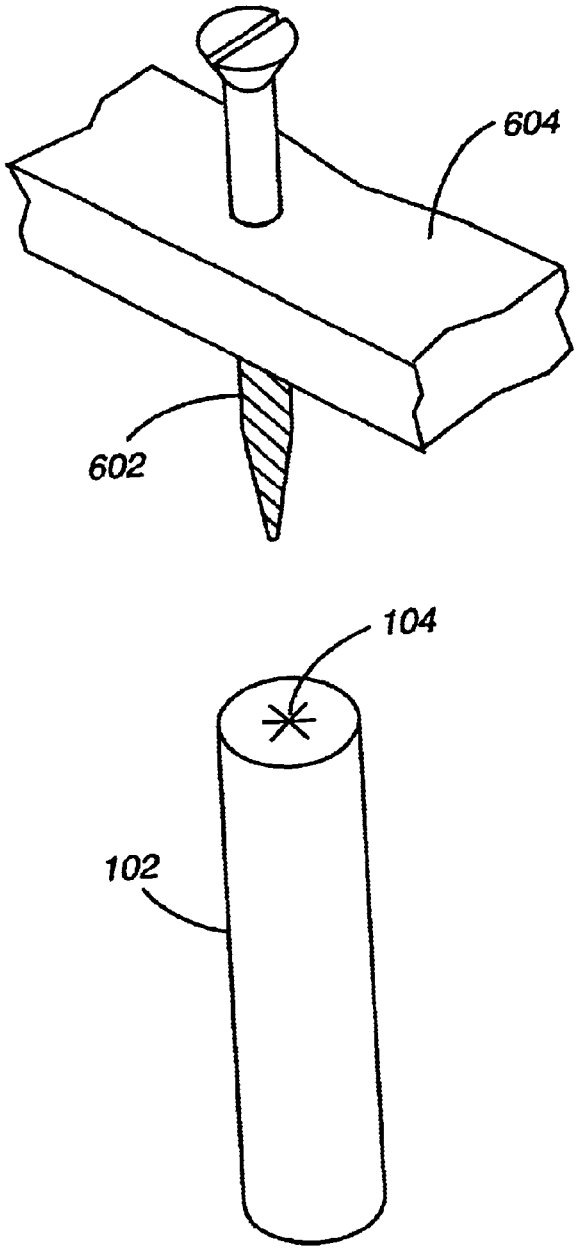
FIG. 6 is and environmental view of the protective device of FIG. 1 and a screw, according to the present invention.

FIG. 6 is and environmental view 600 of the protective device of FIG. 1 and a screw. The screw 602 penetrates a structure 604. The protective device 100 is pushed over the pointy or pointed end of the screw 602 enters the capture 104. The capture 104 retains the screw 602 so as to resist movement of the screw 602 in a direction normal to an axis parallel to the longest side of the body 102.

FIG. 7 is and elevated view 700 of the protective device of FIG. 1 with three different lengths of nails retained in the protective device. Three different lengths of nails 702, 704, and 706 are pushed into the protective device 100. The capture 104 of the protective device 100 retains the nails 702, 704, and 706 so as to not slip off the nail and so as to resist movement of the nail 702, 704, and 706 in a direction normal to an axis parallel to the longest side of the body 102. The protective cap 202 is formed from a material being resistant to penetration there through from the pointy or pointed of the nails 702, 704, and 706.

Figure 8:
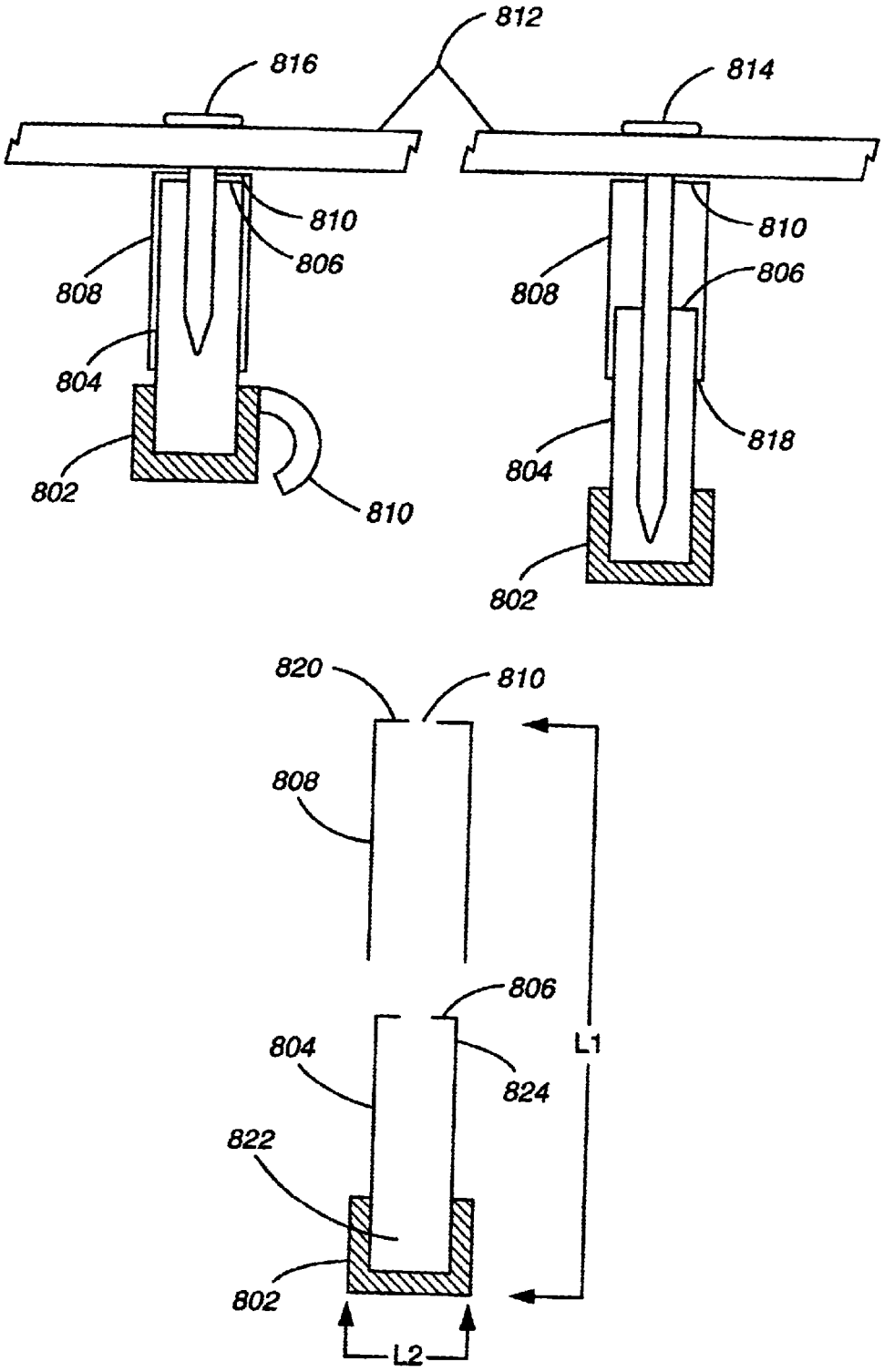
FIG. 8 is an elevated side view of the protective device for an aciculate object embodied as a telescoping body and two different lengths of nails retained in the protective device, according to an alternative embodiment of the present invention.

FIG. 8 is an elevated side view 800 of the protective device for an aciculate object embodied as a telescoping body and two different lengths of nails retained in the protective device. The protective device 800 comprises a plurality of segments 804 and 808 of different diameters with a substantially cylindrical shape. In another embodiment the plurality of segments 804 and 808 are a geometric shape such as a triangle, a pentagon, a hexagon, and a square (not shown). The plurality of segments 804 and 808 are formed from one or more of the following metal, ceramic, plastic, wood, and rubber. In an another embodiment, the plastic are formed from anon-fluorescent and fluorescent plastic so as to glow in the dark or glow when exposed to a black light. The plurality of segments 804 and 808 are slidably coupled to form a hollow telescoping body 818. The hollow telescoping body 818 is formed to be colored including white and/or translucent. The hollow telescoping body 818 is decorated with a design, an image and/or is not decorated as shown. Moreover, the body 818 or the protective device 800 in another embodiment is coated with a rubber, foam, or plastic coating so as to provide a cushion against the surface of the skin as an additional level of protection against scrapes and cuts and lacerations. The hollow telescoping body 818 forms an interior space with a variable length L1. The hollow telescoping body 818 has a first end 820 and a second end 822. A capture 810 is formed into the first end 820 of the hollow telescoping body 818. In another embodiment the internal end 824 of the segment 804 has a capture 806. The capture 810 are formed from one or more of the following a capture nut, a push nut, and a plastic insert with substantially the same shape as the hollow telescoping body 818 with a hole with diameter L3 which is less than a diameter of the aciculate object (not shown). A pointy or pointed end of aciculate objects 814 and 816 penetrates beyond the structure 812. The pointy or pointed end of each of the aciculate objects 814 and 816 is pushed through the capture 810. The capture 810 retains the aciculate objects 814 and 816 to keep them from slipping off and so as to resist movement of the aciculate objects 814 and 816 in a direction normal to an axis parallel to the longest side of the hollow telescoping body 818. The hollow telescoping body 818 is extensible to adjust to different lengths of aciculate objects 814 and 816. A protective cap 802 is mounted to the second end 822 of the hollow telescoping body 818. The protective cap 802 diameter is L2. The protective cap 802 diameter L2 is less than the hollow telescoping body variable length L1. The protective cap 802 is formed from a material being resistant to penetration there through from the pointy or pointed of the aciculate objects 814 and 816. The protective cap 802 are formed from one or more of the following a metal, a ceramic, a plastic, a wood, and a rubber. The protective cap 820 further comprises an exterior hook, such as a cup hook, disposed therefrom for holding object thereon 830.

It is important to note, that the embodiment as described in FIG. 8 describes a telecopying body, it is also possible to add additional length to the body 102 of the protective device 100 of FIG. 1 by joining another hollow segment on either the first end 106 and/or second end 108 of body 102. The additional hollow segment can be pressed on or threaded on or snapped on the body 102 to increase the length without telescoping. This is within the true scope and spirit of the present invention.

Although specific embodiments of the invention have been disclosed, it will be understood by those having skill in the art that changes can be made to this specific embodiment without departing from the spirit and scope of the invention. The scope of the invention is not to be restricted, therefore, to specific embodiments, and it is intended that the appended claims cover any and all such applications, modifications, and embodiments within the scope of the present invention.

What is claimed is:

1. A protective device for protecting against an aciculate object comprising:

a body having a substantially cylindrical shape with a longest side of length L1, wherein the body has a first end and a second end;

a capture formed in the first end of the body; and a protective cap formed separate from the body and mounted to the second end of the body, the protective cap with a diameter L2, so that L2<L1;

wherein the first end of the body is formed to accept through the capture a pointed end of an aciculate object;

wherein the capture is formed to retains the aciculate object so as to resist movement of the aciculate object in a direction normal to an axis parallel to the longest side of the body;

wherein the body is resistant to deformation along the axis parallel to the longest side of the body; and wherein the protective cap is formed from a metal which is non-penetratable there through from the pointy end of the aciculate object.

2. The protective device according to claim 1, wherein the capture is at least one of the following:

a plastic insert with substantially the same shape as the body with a hole of a diameter L3 less than a diameter of the aciculate object;

a push nut; and a capture nut.

3. The protective device according to claim 1, wherein the protective cap is manufactured from at least one of the following:

aluminum;

steel;

iron; and nickle.

4. The protective device according to claim 1, wherein the body is manufactured from at least one of the following:

metal;

ceramic;

plastic;

wood; and rubber.

5. The protective device according to claim 1, wherein the body is filled in at least part with a fill material that engages at least part of the aciculate object and the fill material including at least one of the following:

a plastic;

a foam; and an adhesive.

6. The protective device of claim 1, wherein the protective cap further comprises:

an exterior hook disposed therefrom for holding objects placed thereon.

7. The protective device of claim 1, wherein at least one of the body and the protective cap is made from a fluorescent plastic.

8. A protective device for protecting against an aciculate object comprising:

a body with a longest side of length L1, wherein the body has a first end and a second end;

a capture formed in the first end of the body; and a protective cap formed separate from the body and mounted to the second end of the body, the protective cap with a diameter L2, so that L2<L1;

wherein the first end of the body is formed to accept through the capture a pointed end of an aciculate object;

wherein the capture is formed to retain the aciculate so as to resist movement of the aciculate object in a direction normal to an axis parallel to the longest side of the body;

wherein the body is resistant to deformation along the axis parallel to the longest side of the body; and wherein the protective cap is formed from a metal which is non-penetratable there through from the pointy end of the aciculate object.

9. The protective device according to claim 8, wherein the capture is at least one of the following:

a plastic insert with substantially the same shape as the body with a hole of a diameter L3 less than a diameter of the aciculate object;

a push nut; and a capture nut.

10. The protective device according to claim 8, wherein the protective cap is manufactured from at least one of the following:

aluminum;

steel;

iron; and nickle.

11. The protective device according to claim 8, wherein the body is manufactured from at least one of the following:

metal;

ceramic;

plastic;

wood; and rubber.

12. The protective device according to claim 8, wherein the body is at least filled in part with at least one of the following:

a plastic;

a foam; and an adhesive.

13. The protective device of claim 8, wherein the protective cap further comprises:

an exterior hook disposed therefrom for holding objects placed thereon.

14. The protective device of claim 8, wherein at least one of the body and the protective cap is made from a fluorescent plastic.

15. The protective device of claim 8, wherein the body is selected from the group of geometric shapes consisting of:

a cylinder;

a triangle;

a pentagon;

a hexagon; and a square.

16. A protective device for protecting against an aciculate object comprising:

a plurality of hollow segments of different diameters, wherein each of the segments is slidably coupled to at least one other segment so that the plurality of segments form a hollow telescoping body with a first end and a second end, the hollow telescoping body forming an interior space with a variable length L1;

a capture formed into the first end of the hollow telescoping body;

a protective cap mounted to the second end of the hollow telescoping body;

wherein the hollow telescoping body adjusts along an axis parallel to the variable length L1 to accommodate a range of lengths of the aciculate object;

wherein the first end of the hollow telescoping body is formed to accept through the capture a pointed end of an aciculate object;

wherein the capture device is formed to retains the aciculate so as to resist movement of the aciculate object in a direction normal to an axis parallel to the variable length L1 of the hollow telescoping body;

wherein the hollow telescoping body is resistant to deformation along the axis parallel to the variable length L1 of the hollow telescoping body; and wherein the protective cap is formed from a material being resistant to penetration there through from the pointy end of the aciculate object.

17. The protective device according to claim 16, wherein the capture is at least one of the following:

a plastic insert with substantially the same shape as the body with a hole of a diameter L3 less than a diameter of the aciculate object;

a push nut; and a capture nut.

18. The protective device according to claim 16, wherein the protective cap is manufactured from at least one of the following:

metal;

ceramic;

plastic;

wood; and rubber.

19. The protective device of claim 16, wherein the hollow telescoping body is selected from the group of geometric shapes consisting of:

a cylinder;

a triangle;

a pentagon;

a hexagon; and a square.

20. The protective device of claim 16, wherein the protective cap further comprises:

an exterior hook disposed therefrom for holding objects placed thereon.

21. The protective device of claim 16, wherein at least one of the hollow telescoping body and the protective cap is made from a fluorescent plastic.

* * * * *